US008549998B2

(12) United States Patent
Pikhart et al.

(10) Patent No.: US 8,549,998 B2
(45) Date of Patent: Oct. 8, 2013

(54) PORTABLE ELECTROMECHANICAL BRAILLE LABEL MAKER

(76) Inventors: Karina Nicole Pikhart, Granada Hills, CA (US); Wenxian Hong, Singapore (SG); Michelle Elizabeth Lustrino, Yorktown, NY (US); Jennifer Hayden Rush, Boise, ID (US); Jodie Zujone Wu, Conyers, GA (US); Sarah Shieh, Woodmere, NY (US); Nicole Marley O'Keeffe, Cambridge, MA (US); Josh Karges, Lexington, NE (US); Adelaide Sarah Calbry-Muzyka, Stanford, CA (US); Kwame Joel Hall, Kingston (JM)

( * ) Notice: Subject to any disclaimer, the term of this patent is extended or adjusted under 35 U.S.C. 154(b) by 450 days.

(21) Appl. No.: 12/767,625

(22) Filed: Apr. 26, 2010

(65) Prior Publication Data

US 2010/0269716 A1 Oct. 28, 2010

Related U.S. Application Data

(60) Provisional application No. 61/173,068, filed on Apr. 27, 2009.

(51) Int. Cl.

| | |
|---|---|
| ***B41F 19/02*** | (2006.01) |
| ***B41J 3/32*** | (2006.01) |
| ***B41J 5/00*** | (2006.01) |

(52) U.S. Cl.

USPC ..... 101/18; 400/109.1; 400/132; 400/483

(58) Field of Classification Search

USPC ..... 101/18, 19, 20, 93.18; 400/109.1, 400/129, 132, 134, 134.1, 483; 434/112, 434/113, 114, 115

See application file for complete search history.

(56) References Cited

U.S. PATENT DOCUMENTS

| | | | |
|---|---|---|---|
| 2,454,637 | A | 2/1945 | de la Fuente Tejedo |
| 4,079,825 | A | 3/1978 | Fewell |

(Continued)

FOREIGN PATENT DOCUMENTS

| | | |
|---|---|---|
| EP | 0 962 909 B1 | 11/2007 |

OTHER PUBLICATIONS http://www.indexbrailleaccessibility.com/products/quantum/jotadot.htm; JOT A DOT, site accessed Jun. 25, 2012.

(Continued)

*Primary Examiner* — Ren Yan

(74) *Attorney, Agent, or Firm* — The Marbury Law Group, PLLC

(57) ABSTRACT

A portable apparatus to electromechanically emboss Braille patterns includes a user input, such as a six-key with spacebar keyboard, actuators that drive embossing pins via cam shafts coupled to servo or stepper motors, a tape advancing mechanism, and a cutting and scoring assembly. Three actuators, such as servo or stepper motors, may each be coupled to one shaft on which two or more cams drive two or more embossing pins for each row of two dots in the six dot Braille cell.

5 Claims, 19 Drawing Sheets

(56) References Cited

U.S. PATENT DOCUMENTS

| | | | | |
|---|---|---|---|---|
| 4,261,663 | A | 4/1981 | Grimnes | |
| 4,488,828 | A | 12/1984 | Ohtsuki | |
| 5,449,240 | A | 9/1995 | Dorpfeld et al. | |
| 5,453,012 | A * | 9/1995 | Hudecek | 434/114 |
| 5,746,518 | A | 5/1998 | Ogawa et al. | |
| 5,766,014 | A * | 6/1998 | Ida et al. | 434/114 |
| 6,086,273 | A | 7/2000 | Hong | |
| 6,491,459 | B2 * | 12/2002 | Hosomi | 400/613 |
| 6,827,512 | B1 | 12/2004 | Souluer | |
| 7,029,190 | B1 * | 4/2006 | Davis et al. | 400/483 |
| 7,217,050 | B2 | 5/2007 | Kurashina et al. | |
| 7,278,792 | B2 | 10/2007 | Takada et al. | |
| 7,458,739 | B2 | 12/2008 | Akaiwa | |
| 7,556,444 | B2 | 7/2009 | Kurashina et al. | |
| 2006/0134587 | A1 | 6/2006 | Akaiwa | |
| 2006/0228141 | A1 * | 10/2006 | Takada | 400/76 |
| 2009/0196669 | A1 * | 8/2009 | Murata | 400/207 |

OTHER PUBLICATIONS

Amazon.com/Magnifying-Aids-3M-Braille-Labeler/dp/B001L7OF4I, Braille Labeler: Health & Personal Care, site accessed Jun. 25, 2012.

http://www.yankodesign.com/2009/03/27/make-a-label-for-the-blind/, Yanko Labeler, Designers: Soonkyu Jang, Jieun Seo & Seung-un Kim, site accessed Jun. 25, 2012.

http://www.perkins.org/news-events/news/next-generation.html, Next GenerationTM Perkins/APH Brailler, site accessed Jun. 25, 2012.

http://support.perkins.org/site/MessageViewer?em_id=2141.0&printer_friendly=1, Light Touch Electric Blue, site accessed Jun. 25, 2012.

* cited by examiner

175

PORTABLE ELECTROMECHANICAL BRAILLE LABEL MAKER

RELATED APPLICATIONS

This application claims the benefit of priority to U.S. Provisional Patent Application No. 61/173,068, entitled "Portable Electromechanical Braille Label Maker" filed Apr. 27, 2009, the entire contents of which are hereby incorporated by reference.

FIELD OF INVENTION

The invention relates to an apparatus and method for making Braille labels.

BACKGROUND OF INVENTION

Existing devices that enable users to emboss Braille have traits that make them not ideal for use as a Braille label maker. First, many such devices are large, heavy, and/or bulky. Thus, they are not easily portable. Some portable Braille label makers use a dial that must be manually turned to select the characters to be embossed. The dial takes longer to operate than a Braille keyboard and also does not include many characters that are used in shorthand Braille. In addition, existing Braille label makers are unreliable and produce poor quality labels. At least one reason why these Braille label makers produce poor quality labels is because the user provides the force that creates the Braille dots on the label. Since the user must provide substantial force to produce each Braille dot, the emboss of the Braille dots is inconsistent, leading to a poor quality embossing. In addition, existing Braille label makers waste a lot of labeling tape by cutting the labels far from the edge of the Braille cell. Finally, Braille label makers that emboss on adhesive tape typically do not score the tape for easy peeling.

Thus, there is a need for an improved Braille labeler that is portable, quick to learn and use, is not dependent on the force applied by the user, and reliably produces Braille dots of a consistent size. In addition, there is a need for a Braille labeler that minimizes the waste of labeling tape and scores the adhesive labels for easy application.

SUMMARY

The various embodiments include a portable apparatus to electromechanically emboss Braille patterns onto tape and advance the tape, with the electromechanical components configured to consistently emboss and advance the tape. The apparatus keys may be laid out in a configuration compatible with the six-key with spacebar keyboard commonly found in other Braille writing apparatuses. The apparatus drives the embossing pins with the use of cam shafts coupled to servo or stepper motors, wherein each of the three servo or stepper motors are coupled to one of three shafts on which two cams drive two embossing pins for each row of two dots in the six dot Braille cell. In a further embodiment, the apparatus for embossing a pattern of dots includes a user interface enabling a user to input a pattern of dots, an embossing assembly to emboss the pattern of dots, the embossing assembly including one or more actuators, a plurality of embossing pins, and a die assembly, wherein each actuator is coupled to a shaft, each shaft including at least two cams for driving two or more embossing pins into the die assembly, and a controller for controlling the embossing assembly. The apparatus may further include a tape advance assembly including a housing, a tape slot and a friction wheel, and a cover including an idler wheel positioned so that the idler wheel engages the friction wheel to hold a piece of labeling tape in place and press the tape against the friction wheel when the cover is closed on the housing. The apparatus may further include a combined tape cutting and scoring assembly including a cutting blade, a scoring blade, and a compliant connection mechanism, wherein the scoring blade is attached to the cutting blade using the compliant connection mechanism.

BRIEF DESCRIPTION OF THE DRAWINGS

The accompanying drawings, which are incorporated herein and constitute part of this specification, illustrate exemplary embodiments of the invention, and together with the general description given above and the detailed description given below, serve to explain the features of the invention.

DETAILED DESCRIPTION

Figure 1A:
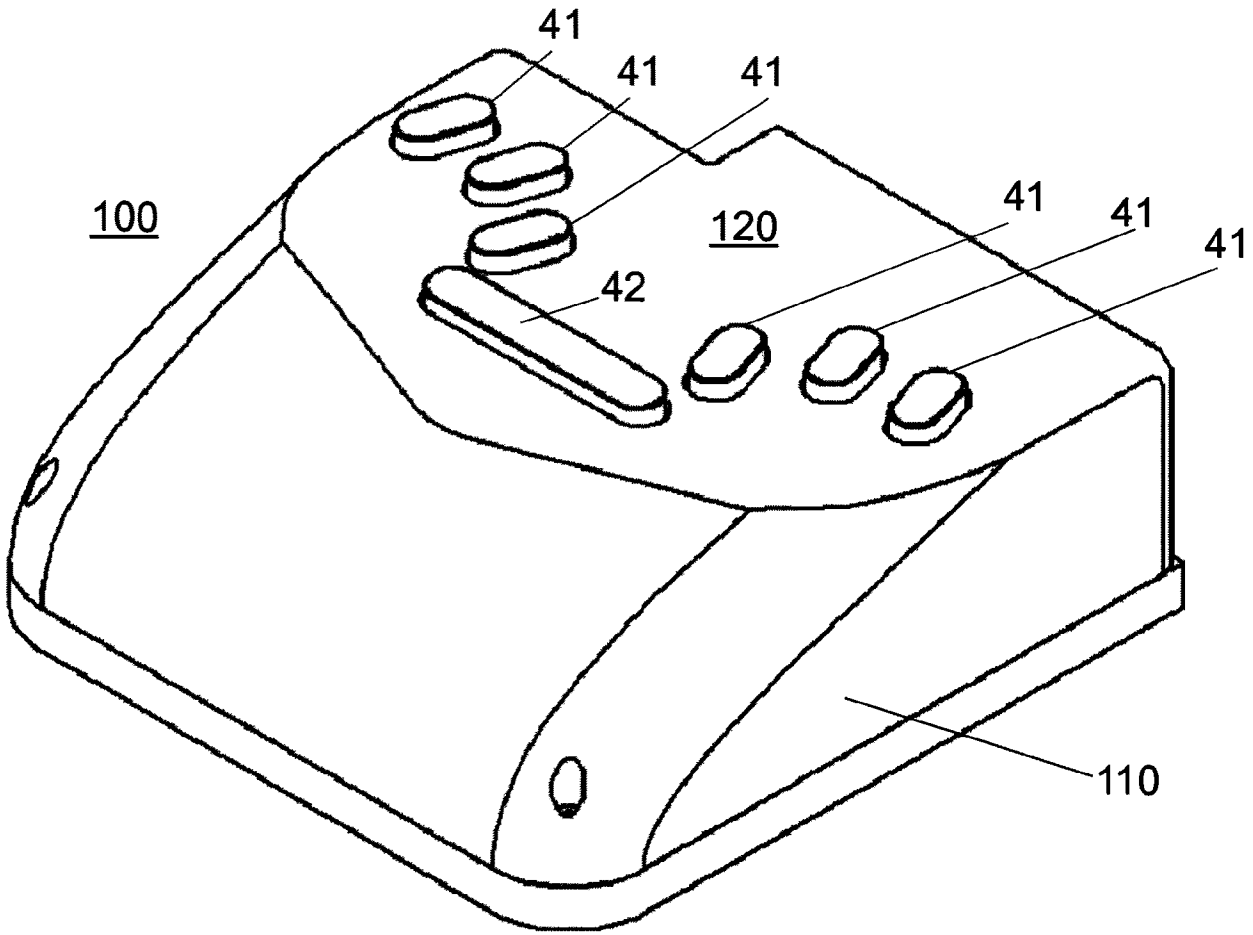
FIG. 1A is an isometric view of one embodiment of a portable electromechanical Braille label maker.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

A portable Braille label maker includes at least a user interface enabling a user to input the desired contents of a Braille label and an embossing mechanism for embossing the Braille onto a labeling medium.

FIGS. 1A-12C, wherein like parts are designated by like reference numerals throughout, illustrate example embodiments of a portable electromechanical Braille label maker. Although the portable electromechanical Braille label maker will be described with reference to the example embodiments illustrated in the figures, it should be understood that the portable electromechanical Braille label maker may be embodied in many alternative forms. One of ordinary skill in the art will additionally appreciate different ways to alter the parameters of the embodiments disclosed, such as the size, shape, elements, or materials, without departing from the spirit and scope of the portable electromechanical Braille label maker.

Figure 1B:
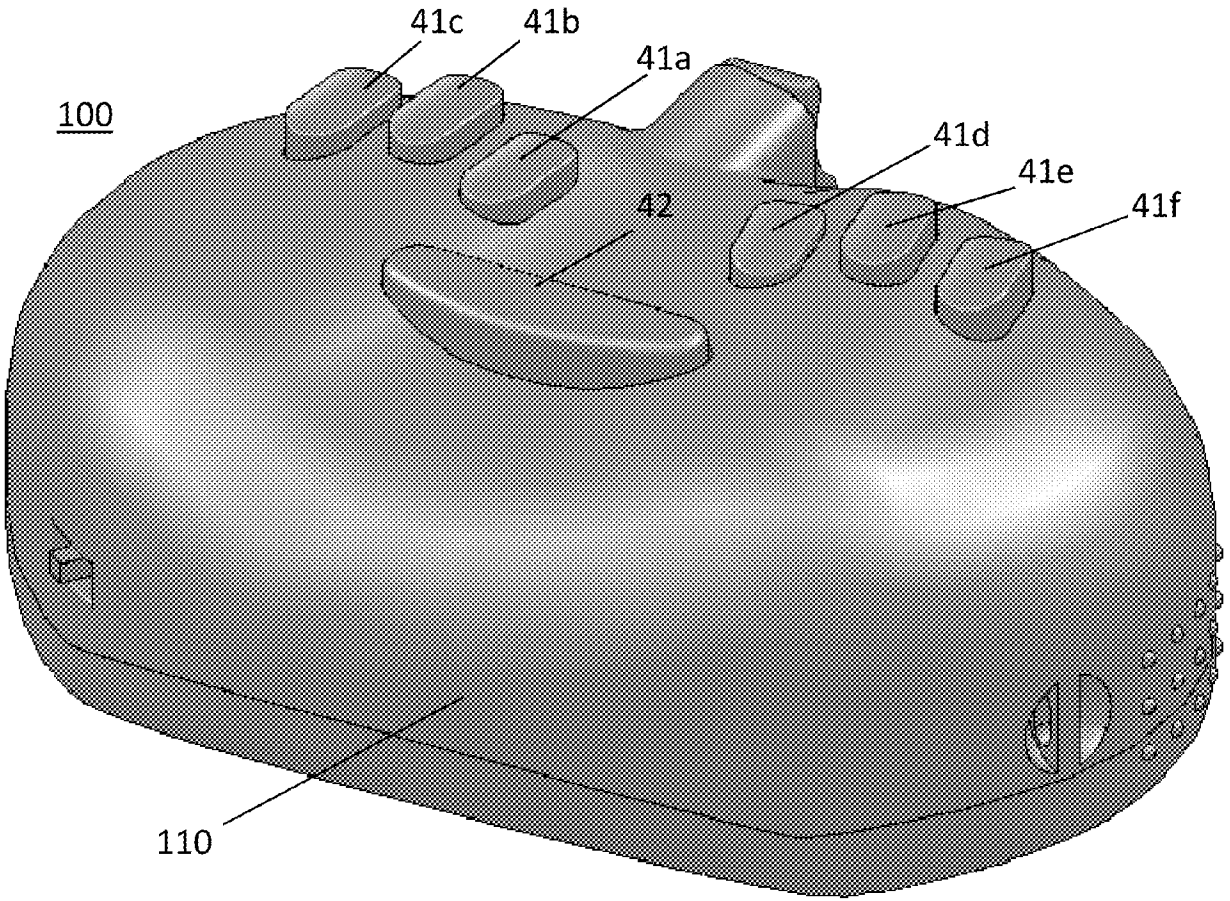
FIG. 1B is an isometric view of another embodiment of a portable electromechanical Braille label maker.

FIG. 1A is an isometric view of an embodiment of a portable Braille label maker 100. The portable Braille label maker 100 includes an outer shell 110 and a user interface 120 disposed on a surface of the outer shell 110. The outer shell 110 encloses mechanisms, to be described, for creating Braille labels. The outer shell 110 preferably provides wrist support and conforms to a user's hand. FIG. 1B shows another embodiment of an outer shell 110 of a portable Braille label maker 100. The outer shell 110 may be made of any suitable material, including, but not limited to, any thermoplastic or thermosetting material, such as ABS, PVC, polycarbonate, and acrylic, as well as other materials, such as aluminum. Preferably, a durable, lightweight material is used. The outer shell 100 may be manufactured using any suitable process, such as, but not limited to, vacuum forming, casting or stamping. The outer shell 110 may be opaque, or it may include one or more transparent or translucent portions enabling a user to see the mechanisms enclosed within.

Figure 2:
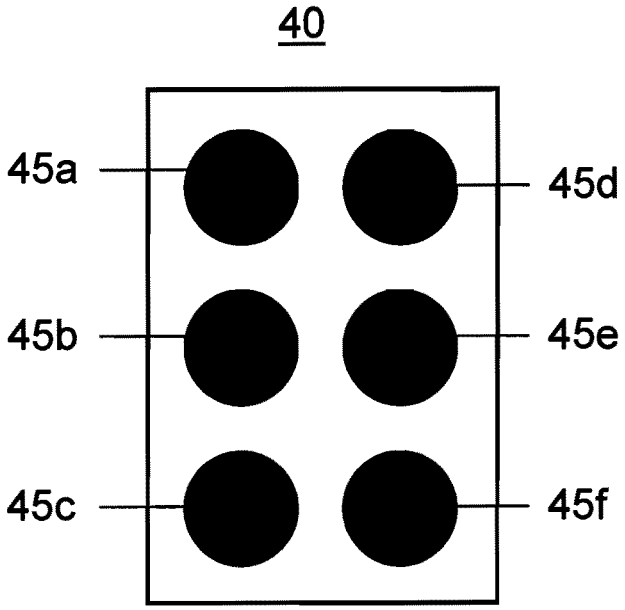
FIG. 2 is an illustration of a standard 6-dot Braille cell.

The user interface 120 enables a user to input the desired Braille characters for a Braille label easily and quickly. As shown in FIG. 1A, one embodiment of the user interface 120 includes six buttons 41*a*-41*f*, each of which corresponds to a particular dot position 45*a*-45*f* in a standard Braille cell 40, as illustrated in FIG. 2. The user interface 120 further includes a space bar 42 for indicating the end of Braille words or when extra space is desired between Braille characters. Preferably, the buttons 41*a*-41*f* and the space bar 42 are placed appropriately for comfortable hand, wrist, and finger positioning. While the illustrated embodiment provides a six button plus space bar layout for inputting standard Braille characters, alternative embodiments, such as an eight button plus space bar layout for inputting extended Braille characters may be provided. Furthermore, modified versions of standard keyboards may alternatively be provided to enable non-Braille users to produce Braille labels. The user interface may be implemented in any suitable manner, including, but not limited to, the use of any type of button or key (such as hard-contact keys or capacitive keys), levers, or a touch screen.

Figure 1C:
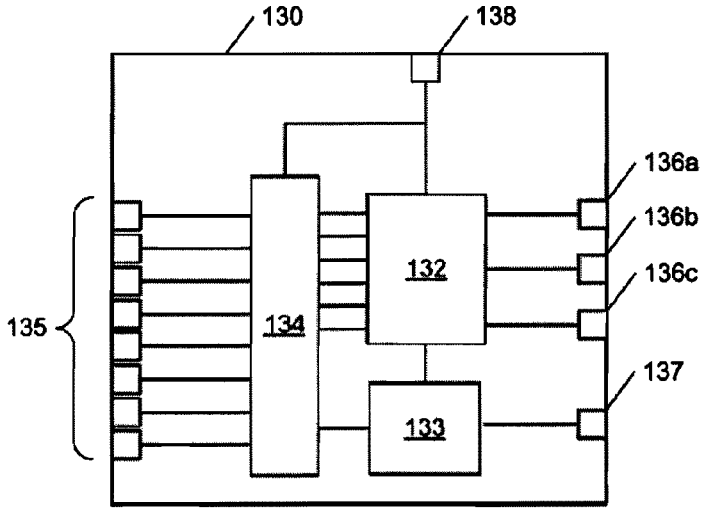
FIG. 1C is a circuit block diagram of an embodiment circuit board suitable for use in an embodiment.

FIG. 1C shows a first embodiment electronics board 130 that may be positioned within the outer shell 110 and configured to receive input from the user interface 120. The electronics board 130 includes a controller circuit 132 that is configured to control an embossing assembly 140 (illustrated in FIGS. 3 and 4), such as by providing electrical signals via connectors 136*a*-136*c* that are connected to actuators 1*a*-1*c* in the embossing assembly 140. As described below with reference to FIGS. 3 and 4, the embossing assembly 140 is configured to emboss Braille characters onto a labeling medium 50. The controller 132 may be implemented using a suitable electronics chip, such as a configurable relay circuit. The electronics board 130 may include a power connector 138 for connecting to and receiving power from the power supply. The electronics board 130 may include a buffer 134 electronically coupled to the controller 132 and to connectors 135 that connect to the user interface 120 and configured to receive and store inputs from the user interface 120. In such an embodiment, the buffer 134 stores the user input, and the controller 132 retrieves the user input from the buffer 134, thus enabling the user to type faster than the embossing assembly 140 can operate. The buffer 134 may implement any suitable buffering mechanism, including, but not limited to, a first-in, first-out buffer or latch circuit. The electronics board 130 may also include a tape advancer controller 133 coupled to the buffer 134, and configured to control a labeling medium advancer 150 (illustrated in FIG. 7) by sending control signals (e.g., power applied from the power connector 138) to the advancer servo or stepper motor 21. The tape advancer controller 133 may be implemented using a suitable electronics chip, such as a configurable relay circuit. One of the controller 132 or tape advancer controller 133 (or another controller) may be coupled to a mechanized labeling medium cutting mechanism and/or a labeling medium scoring mechanism in embodiments that feature mechanized versions of the cutting and scoring mechanisms described below with reference to FIGS. 7-11.

Figure 1D:
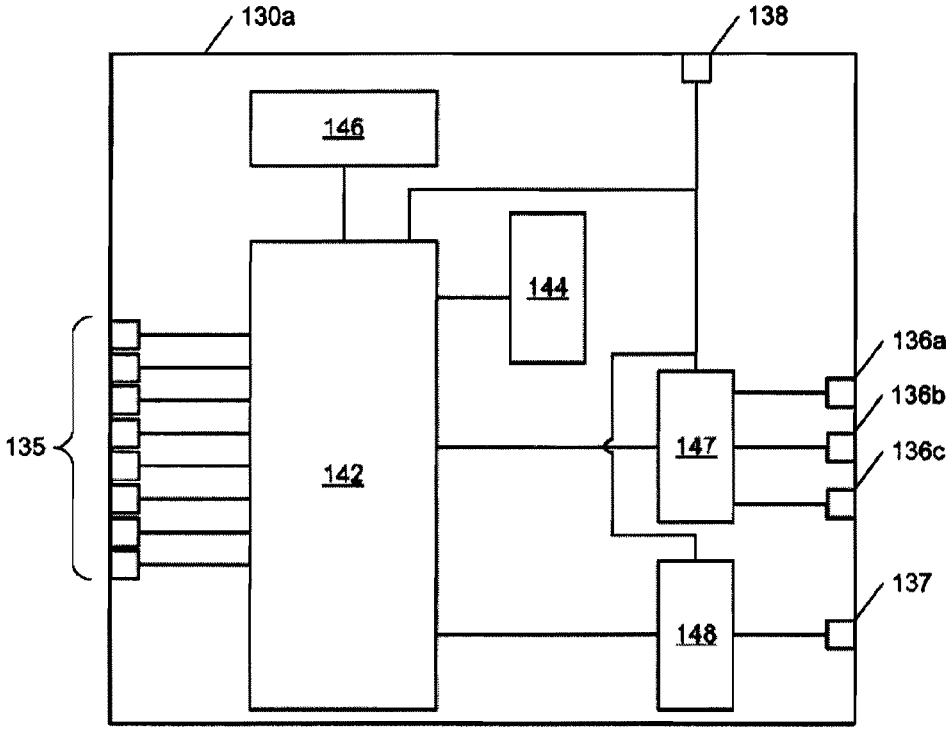
FIG. 1D is a circuit block diagram of another embodiment circuit board suitable for use in an embodiment.

FIG. 1D shows a second embodiment of the electronics board 130*a* in which the controller is in the form of a general purpose microprocessor or microcontroller 142 that is configured with processor-executable software instructions and coupled to connectors 135 for receiving inputs from the user interface 120. This embodiment of the electronics board 130*a* may include a buffer memory 144 electronically coupled to the controller 142 for storing inputs from the user interface 120 to enable the user to type faster than the embossing assembly 140 can operate or to store label inputs so that the same information can be embossed multiple times without requiring the user to re-enter the same information each time. The electronics board 130*a* may further include a non-volatile memory 146, such as FLASH memory, for storing program software for configuring the controller 142. The electronics board 130*a* may include an actuator interface circuit 147 and a servo interface circuit 148 coupled to the controller 142 to receive commands from the controller 142 and relay the commands to the embosser actuators 1*a*-1*c* and tape advancer servo or stepper motor 21 in a suitable format (e.g., by applying voltage from the power supply connection 138 via the actuator or servo connectors 136, 137. In an alternative embodiment, the buffer memory 144 may use memory within the controller 142 chip instead of in a separate memory chip as illustrated in FIG. 1D. The controller 142 may also be electronically coupled to a mechanized labeling medium cutting mechanism and/or a labeling medium scoring mechanism in embodiments that feature mechanized versions of the cutting and scoring mechanisms described below with reference to FIGS. 7-11.

The labeling medium 50 may be manufactured from any suitable material, including, but not limited to, paper and vinyl. The labeling medium 50 may also be in any suitable form factor, including, but not limited to, individual labels, labels on a sheet, or labels in a roll, such as a labeling tape. The labeling medium 50 may also be backed by or integrated with any suitable applicator, such as, but not limited to, an adhesive applicator or a magnetic medium. The labeling medium 50 may be of any color or size.

Figure 3:
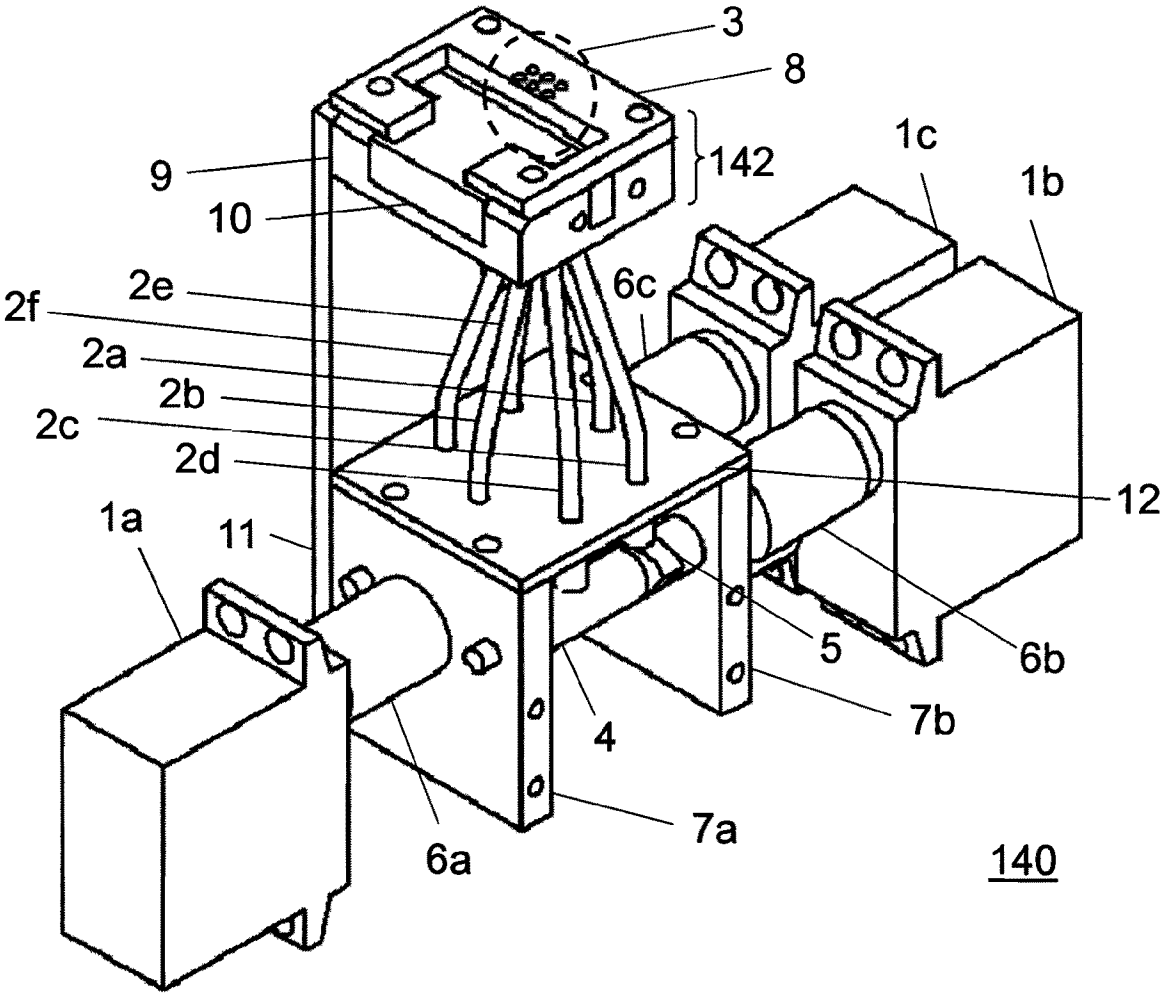
FIG. 3 is an isometric view of one embodiment of an embossing assembly for a portable electromechanical Braille label maker.
Figure 4:
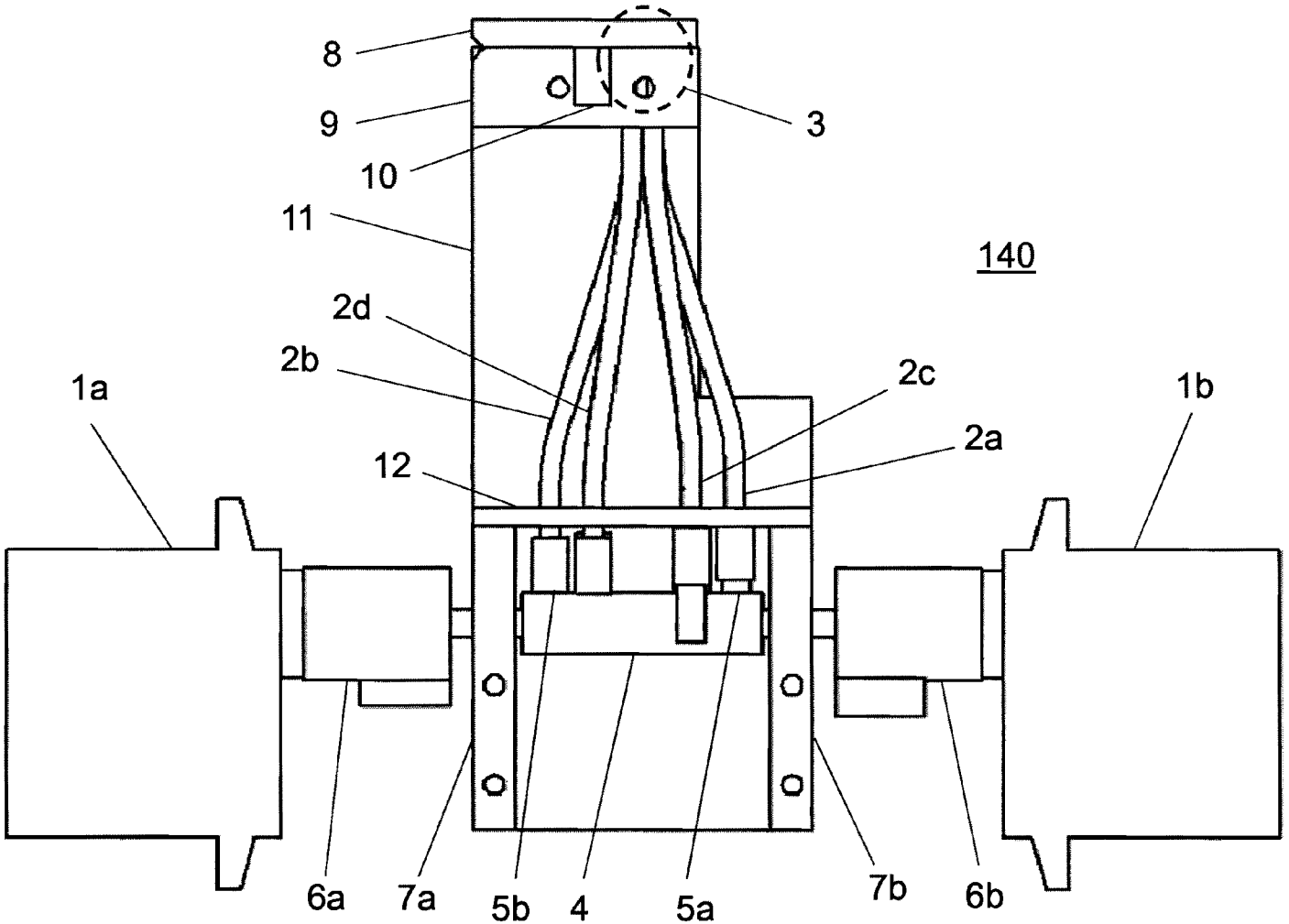
FIG. 4 is a plan view of the embodiment illustrated in FIG. 3.

Embodiments of the embossing assembly 140 are illustrated in FIGS. 3 and 4. The embossing assembly 140 includes one or more actuators 1*a*-1*c*. Each actuator 1*a*-1*c* drives one or more shafts 4. One or more cams 5 are disposed on each shaft 4. The cams 5 may be offset along the length of the shaft 4, as best seen in FIGS. 5B and 5C. One embossing pin 2 may be provided for each dot position 45 in the Braille cell 40, which may be either the standard 6-dot Braille cell or the extended 8-dot Braille cell. Each embossing pin 2 is positioned so that the embossing pin 2 is actuated by a cam 5 on a shaft 4.

FIG. 3 is an isometric view of an embodiment of an embossing assembly 140 using three actuators 1*a*-1*c*, where each actuator 1*a*-1*c* drives one shaft 4 (only one of which is shown in FIG. 3), and each shaft 4 has two or more cams 5*a*, 5*b* disposed on it (the perspective in FIG. 3 shows only a single cam 5, but FIGS. 5*b* and 5C show two cams). The shaft 4 may be coupled to the actuator using any suitable mechanism, such as, for example, a coupler 6. The illustrated embodiment provides six embossing pins 2*a*-2*f* for embossing the standard 6-dot Braille cell. Each embossing pin 2*a*-2*f* is positioned to be actuated by one of the two or more cams 5*a*, 5*b* on one of the three shafts 4. Bearing plates 7*a*, 7*b* may be provided for supporting the shafts 4. A bottom guide plate 12 may be used to provide holes to hold the embossing pins in place. The bearing plates 7*a*, 7*b* and bottom guide plate 12 may be attached to form a structure that holds the shafts 4 and embossing pins 2 in a desired position relative to each other. A first end of each embossing pin 2 may rest on a cam 5*a*, 5*b* or shaft 4. A second end of each embossing pin 2 is used to emboss the Braille dot on the labeling medium 50. FIG. 4 is a front view of the embossing assembly 140 embodiment illustrated in FIG. 3.

A particularly advantageous aspect of the Braille embosser is the use of a single actuator 1 and drive shaft 4 for actuating two or more pins. By positioning at least two cams 5*a*, 5*b* on a single shaft configured to actuate at least two embossing pins 2*a*, 2*b*, the present invention reduces the size and weight of the embosser by reducing the number of actuators 1 by half compared to conventional Braille embossers which require an actuator for each embossing pin. This enables the Braille embosser to be portable and useable in applications where bulkier machines are unsuitable.

Figure 5A:
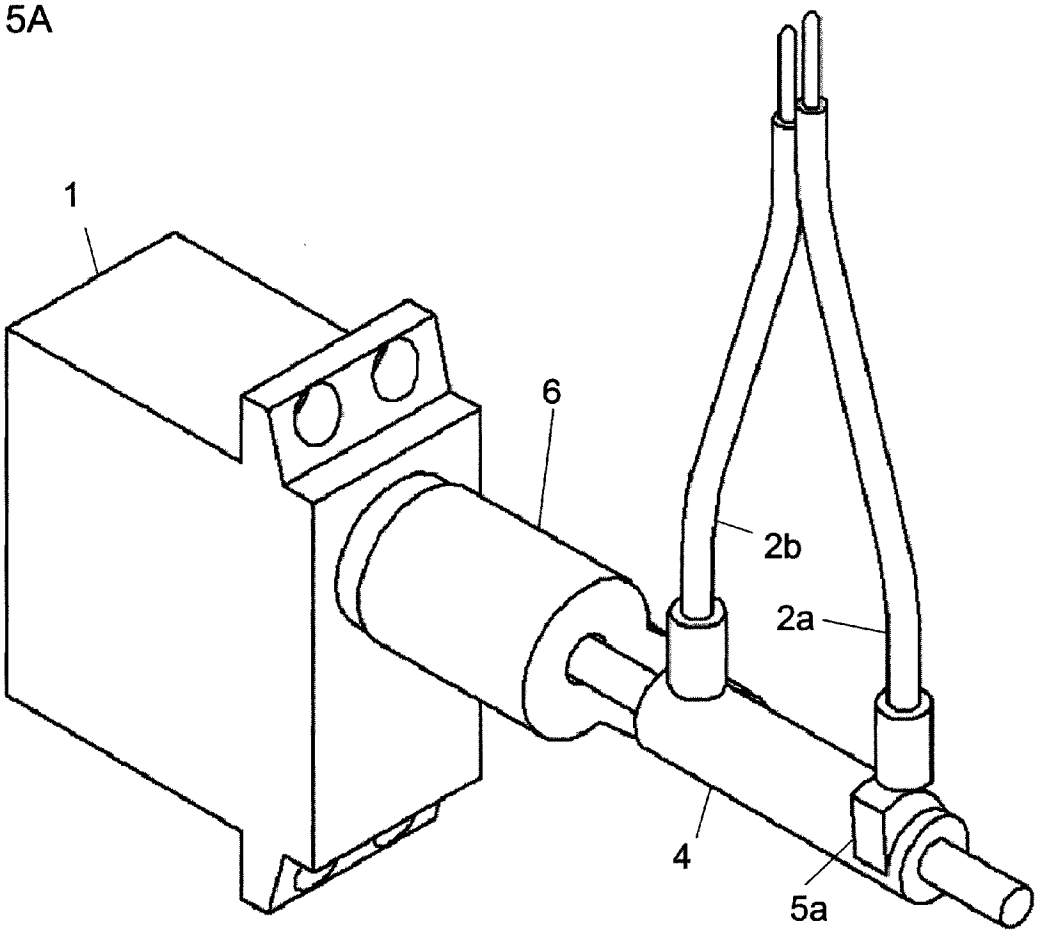
FIG. 5A is an isometric view of one actuator and its corresponding components for an embodiment of an embossing assembly in which one of two embossing pins is actuated.
Figure 5B:
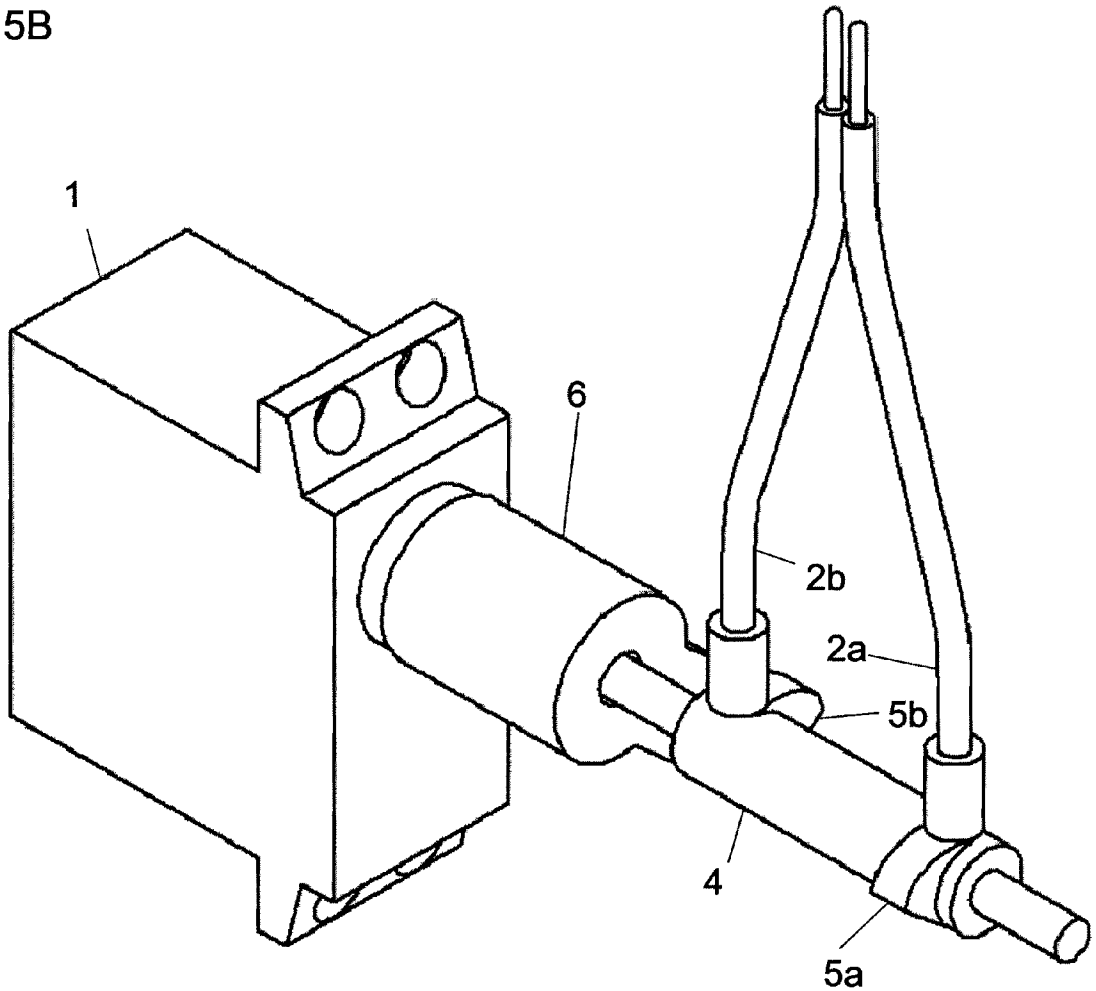
FIG. 5B is an isometric view of the actuator and corresponding components illustrated in FIG. 5A in which none of the embossing pins are actuated.
Figure 5C:
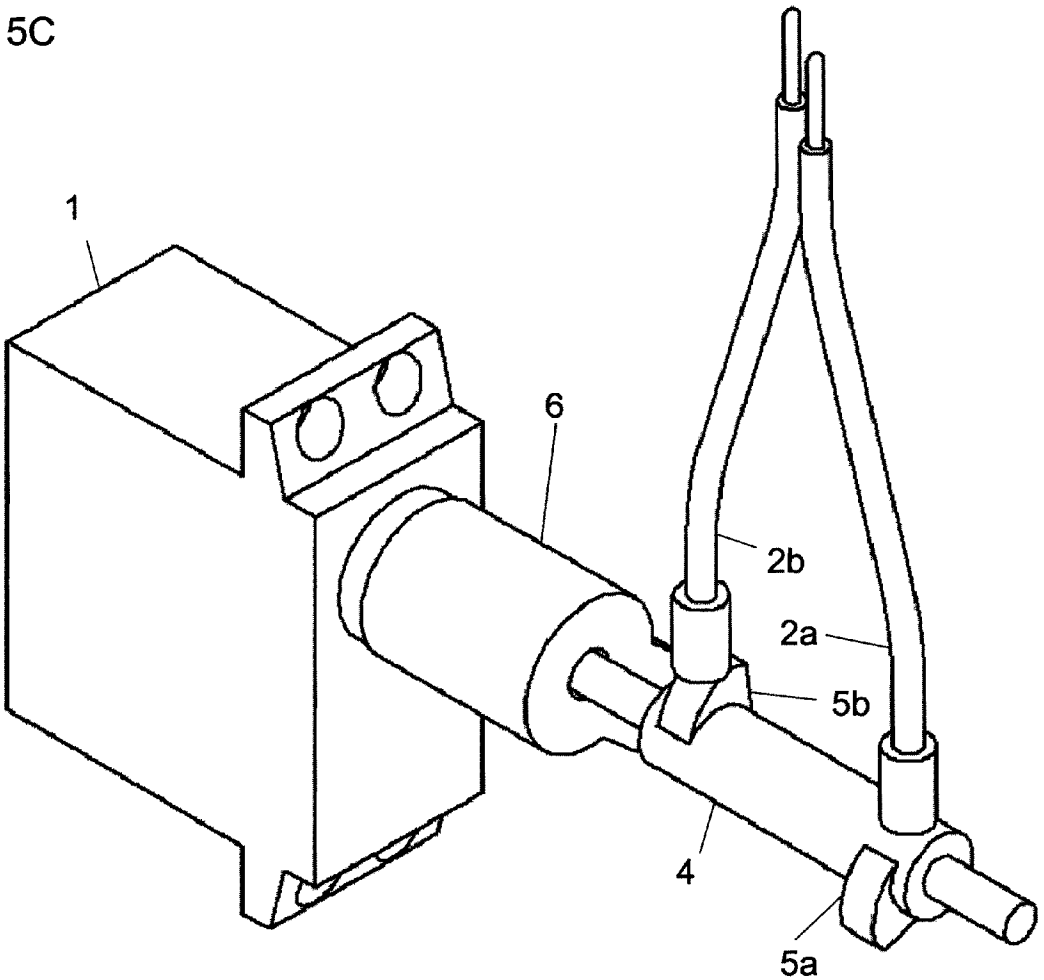
FIG. 5C is an isometric view of the actuator and corresponding components illustrated in FIG. 5A in which the other of the two embossing pins is actuated.
Figure 6A:
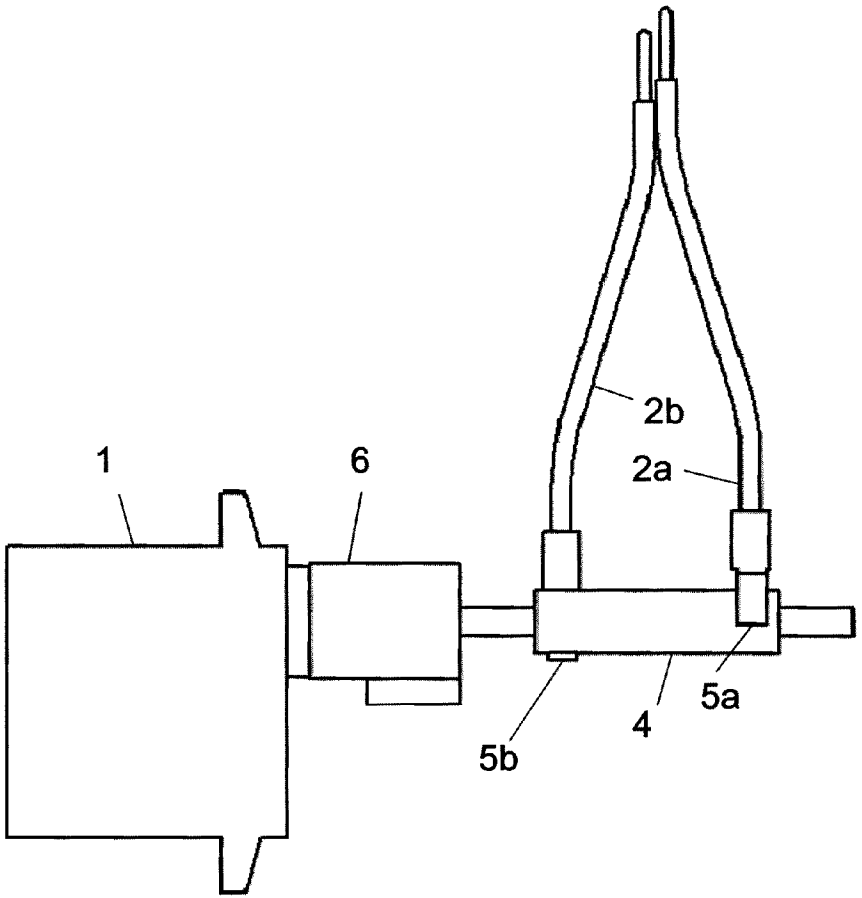
FIG. 6A is a plan view of the embodiment illustrated in FIG. 5A.
Figure 6B:
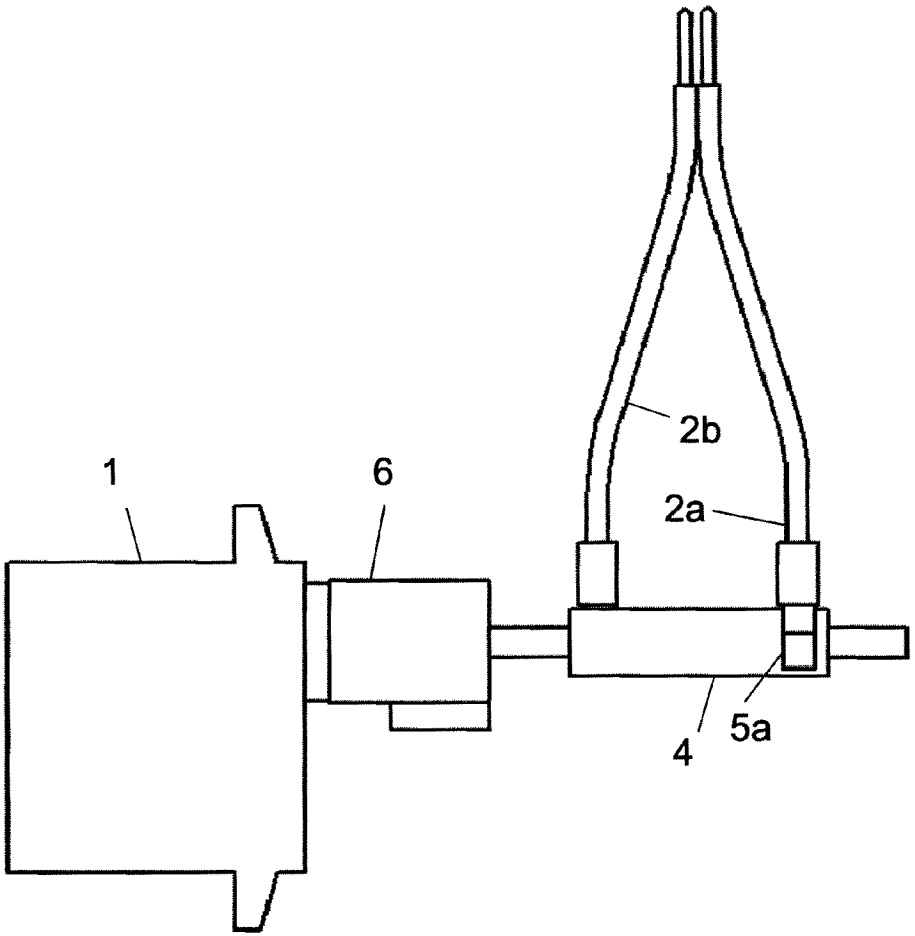
FIG. 6B is a plan view of the embodiment illustrated in FIG. 5B.
Figure 6C:
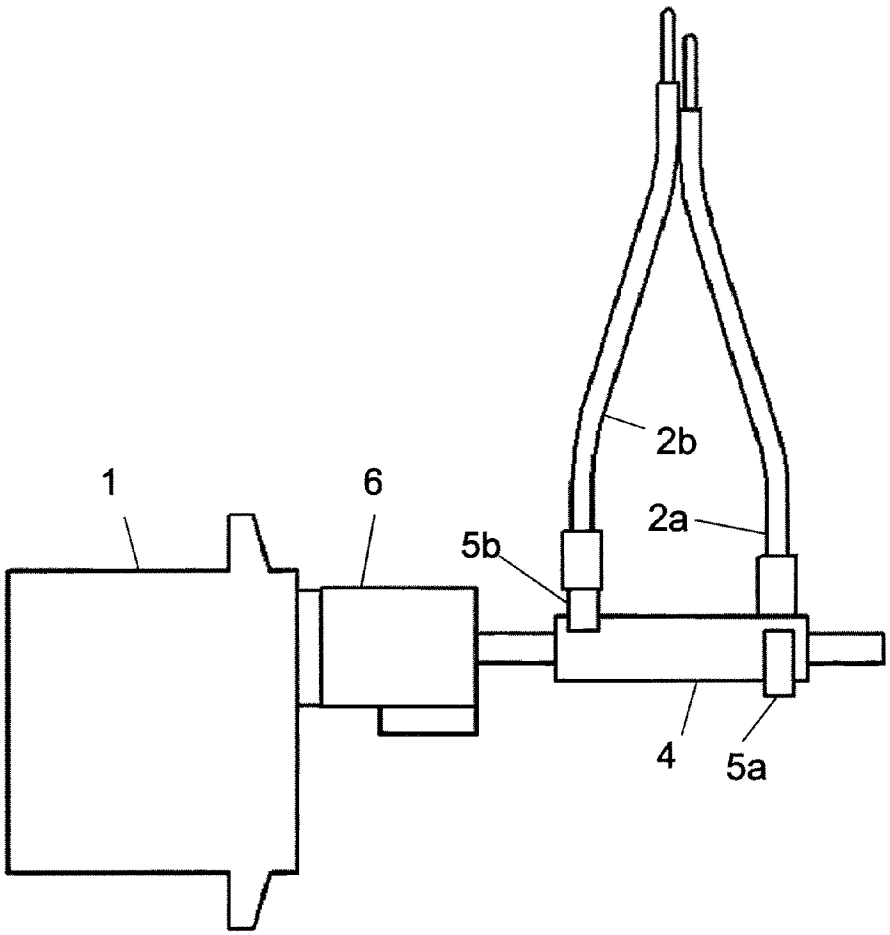
FIG. 6C is a plan view of the embodiment illustrated in FIG. 5C.

Actuation of the embossing pins using an example embodiment of a single actuator 1 and single shaft 4 is illustrated in isometric views in FIGS. 5A-5C and the corresponding plan views are shown in FIGS. 6A-6C. In FIGS. 5A and 6A, the shaft 4 is oriented so that the cam 5*a* closer to the end of the shaft 4 is raising, or actuating, the first embossing pin 2*a*. FIGS. 5B and 6B show the shaft in a neutral position, where neither embossing pin 2*a* or 2*b* is raised by cam 5*a* or 5*b*, respectively. FIGS. 5C and 6C show the shaft oriented so that the cam 5*b* is raising, or actuating, the second embossing pin 2*b*. The actuator 1, generally orients the shaft 4 in the neutral position shown in FIGS. 5B and 6B. The controller 132 controls the actuator 1 to rotate the shaft 4 to actuate the desired embossing pin 2*a* or 2*b*. In the event that both embossing pins 2*a* and 2*b* need to be actuated, the controller 132 would control the actuator 1 to rotate the shaft 4 to actuate one of the embossing pins 2*a* or 2*b* and then to actuate the other of the two embossing pins 2*a* or 2*b*. Although the illustrated embodiments show a shaft 4 with two cams 5*a* and 5*b* driving two embossing pins 2*a* and 2*b*, respectively, the shaft 4 may include only one cam 5 to drive one embossing pin 2 or alternatively include more than two cams 5 driving more than two embossing pins 2.

The actuator 1 may be any suitable actuator that can be controlled to rotate the shaft 4 to the one or more desired positions. For example, the actuator 1 may be a servo motor or a stepper motor. The controller 132 may be coupled to the actuator 1 and configured to control the actuator 1 to rotate in one direction to actuate one embossing pin 2 and to rotate in another direction to actuate another embossing pin 2. The control 132 may return the actuator 1 to the neutral position after actuating each embossing pin 2. For example, the controller 132 may be configured to energize the actuator 1 in one direction to a predetermined angle or number of steps to rotate the shaft 4 to a desired position and then energize the actuator 1 in the opposite direction for the predetermined amount of time or number of steps to return the shaft 4 to its neutral position.

The actuation of an embossing pin 2 raises the second end of the embossing pin 2 towards the die assembly 142 shown in FIGS. 3 and 4. As shown in FIGS. 3 and 4, a backing plate 11 may be used to position the die assembly 142 relative to the structure formed by the bearing plates 7 and bottom guide plate 12. The labeling medium 50 is positioned between the upper guide plate 9 and the stamp plate 8. The upper guide plate 9 includes holes (not shown) that guide the second end of each embossing pin 2 toward and away from the stamp plate 8. Preferably, the holes minimize friction in guiding the embossing pins 2 and properly constrain the pin orientation. The stamp plate 8 includes an embossing area 3 that may include the pattern to be created by the embossing pins 2. The stamp plate 8 may provide the embossing area 3 in any suitable manner. For example, the stamp plate 8 may provide the embossing area 3 using indentations. Preferably, the stamp plate 8 provides the embossing area 3 using holes. In order to emboss a dot, an embossing pin 2 is actuated, translating the second end of the embossing pin 2 toward the stamp plate 8. The labeling medium 50 is pressed between the actuated embossing pin 2 and the indentation, or hole, in the stamp plate 8, which acts as a die. The stamp plate 8 may be designed such that it can accommodate more than one width of labeling medium 50 by the use of a multi-level entry slot. As the medium 50 enters the stamp plate 8, it may be forced onto one of two or more stacked pathways, determined by the width of the tape.

Figure 7:
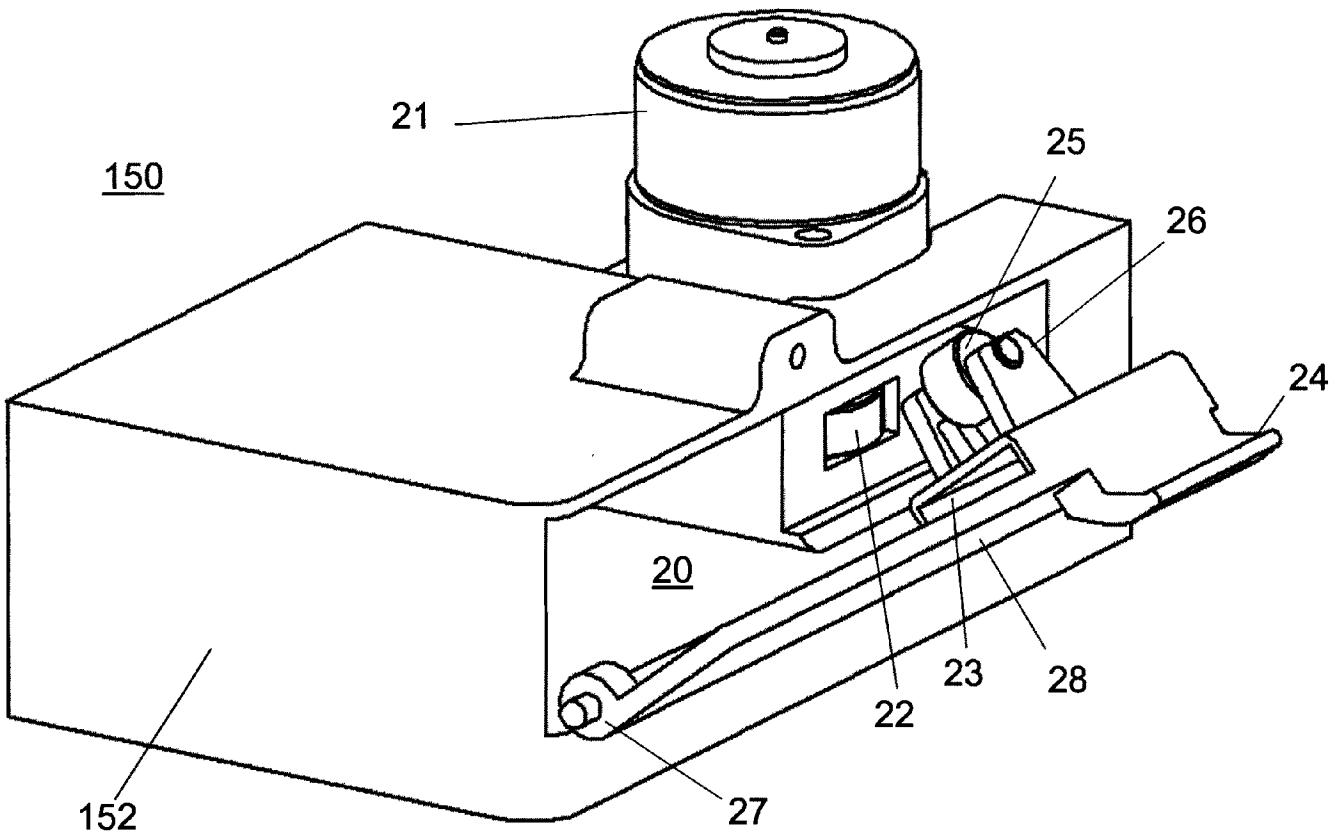
FIG. 7 is an isometric view of an embodiment of a tape advancing assembly that includes a housing and a door for a portable electromechanical Braille label maker.
Figure 8:
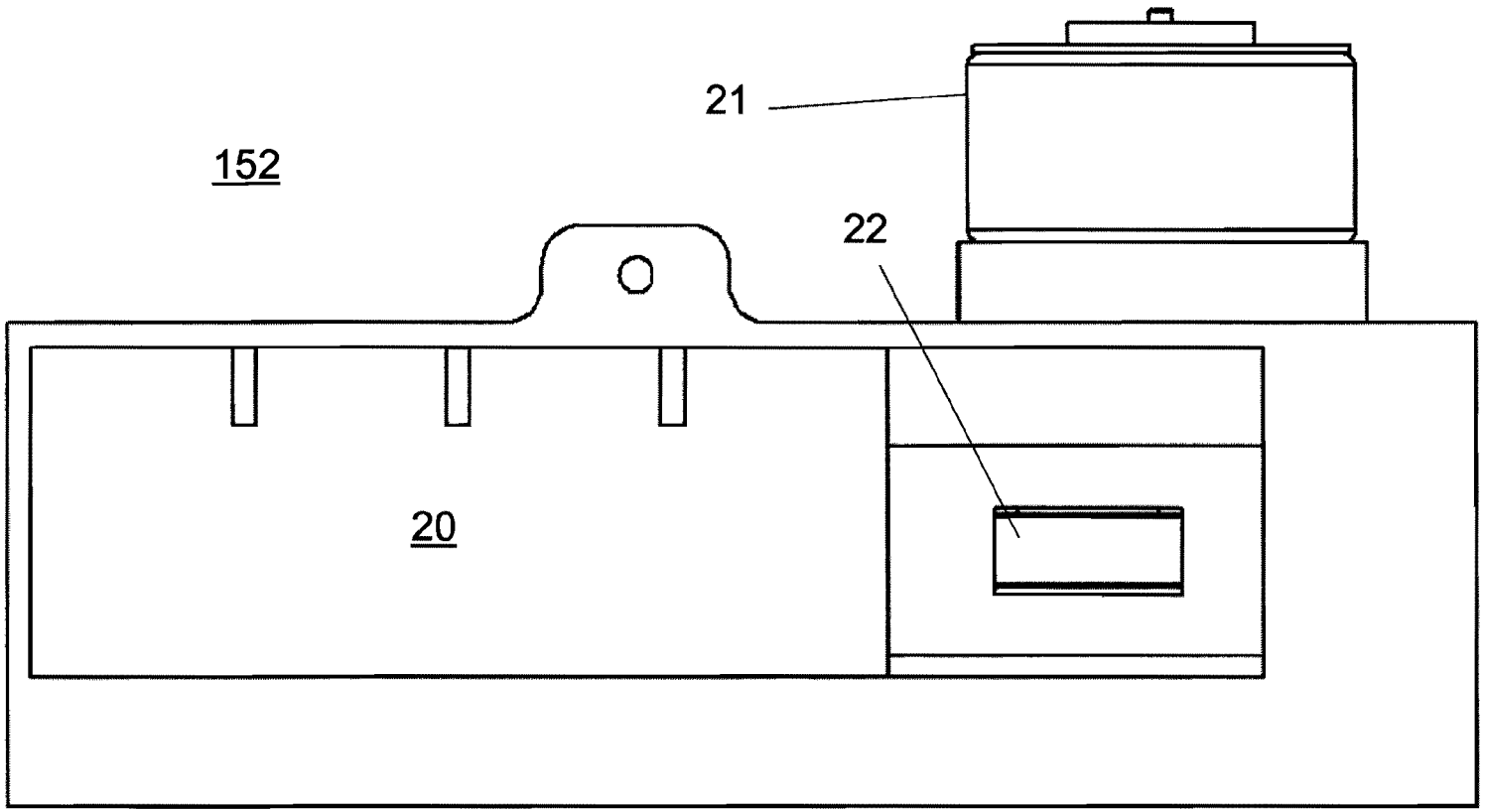
FIG. 8 is a plan view of the housing illustrated in FIG. 7.
Figure 9:
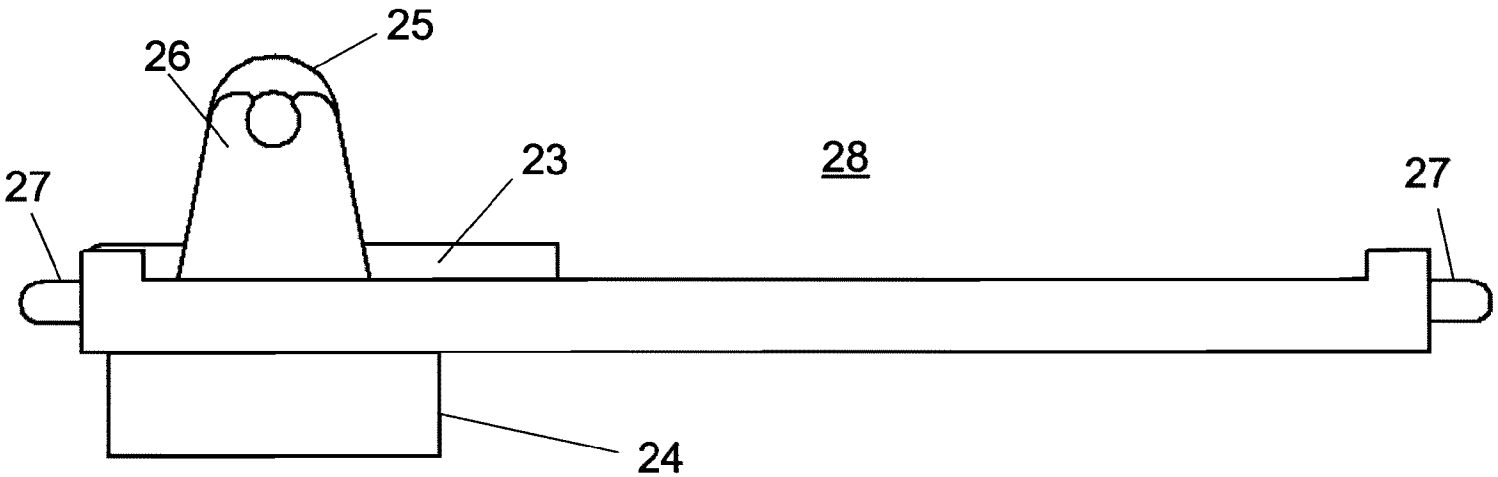
FIG. 9 is a plan view of the door illustrated in FIG. 7.

The portable Braille label maker 100 may support a labeling medium 50 in the form of a roll, such as commonly available labeling tape for making magnetic or adhesive labels. For such embodiments of the portable Braille label maker 100, a tape advancer 150 may be provided. Any suitable mechanism for advancing the labeling medium 50 may be provided. One embodiment of a tape advancer 150 is illustrated in FIGS. 7-9. FIG. 7 shows an isometric view of an embodiment of a tape advancer 150. This embodiment includes a housing 152 and a door, or cover, 28. A plan view of one embodiment of the housing 152 is illustrated in FIG. 8. A plan view of one embodiment of the door 28 is illustrated in FIG. 9.

As shown in FIGS. 7 and 8, the housing 152 may include a tape slot 20 and a friction wheel 22. A tape advancer actuator 21 is coupled to the friction wheel 22.

As shown in FIGS. 7 and 9, the door 28 may include an idler wheel 25 rotatably supported and positioned by a bracket 26 portion of the door 28. A magnet (not shown) may be provided in or on the door 28 to provide a holding force when the door is closed. For example, the magnet may be placed in a magnet slot 23. Alternatively, the magnet may be attached to the door using an adhesive or fastener. The door 28 may also provide a tab 24, or handle, so that the door 28 may be easily opened.

The labeling medium 50, such as labeling tape, is placed in the tape slot 20. The tape slot may include a moveable tape holder that can extend beyond the body of the device so as to make the loading of tape easier. This may be accomplished by means of a sliding drawer mechanism that is actuated by the user's opening of the tape door 28. A first portion of the tape 50 is pulled off the roll and placed over the friction wheel 22. The door 28 may be coupled to the housing 152 in any suitable manner. For example, the door 28 may be attached to the housing 152 by the use of a hinge. Alternatively, as illustrated in FIGS. 7 and 9, the door 28 may be coupled to the housing 152 by the use of protruding ends 27 that fit into receptacles (not shown) in the housing 152 to provide an axis around which the door 28 may pivot. When the door 28 is closed, the portion of the tape 50 that was placed over the friction wheel 22 is positioned between the friction wheel 22 and the idler wheel 25. The magnet on the door 28 engages the idler wheel 25 against the friction wheel 22, so that the tape 50 is held in place between the idler wheel 25 and the friction wheel 22. The idler wheel 25 may also be engaged against the friction wheel 22 using any other suitable mechanism so that closing the door 28 engages the tape 50. When the labeling medium 50 is a roll of labeling tape, a tape-level indicator may be added with a follower that rests upon the circumference of the tape roll. As the circumference of the tape roll decreases, the tape roll follower moves so as to give an indication of the amount of tape within the tape housing 152.

The controller 132 may be configured to control the tape advancer actuator 21 to rotate a coupled shaft (not shown) by a first fixed angle each time a space is needed between characters. The tape advancer actuator 21 may be any suitable drive mechanism including, but not limited to, a stepper motor or a servo motor. In addition, the controller 132 may be configured to control the tape advancer actuator 21 to rotate the coupled shaft by a second fixed angle each time a space is needed between words (as indicated by the user's use of the space bar). The rotation of the shaft coupled to the tape advancer actuator 21 drives the coupled friction wheel 22, which results in the advancing of the tape 50 by the desired length. The friction wheel 22 may be either directly or indirectly coupled to the shaft coupled to the tape advancer actuator 21.

In one embodiment of the portable Braille label maker 100, a label cutting mechanism may be provided to cut the labeling medium 50, when the labeling medium does not provide pre-cut individual labels, such as when the labeling medium 50 is in the form of a roll. When the labeling medium 50 is an adhesive tape, a combined tape cutting and scoring mechanism may be provided to score the tape for easy peeling.

Figure 10:
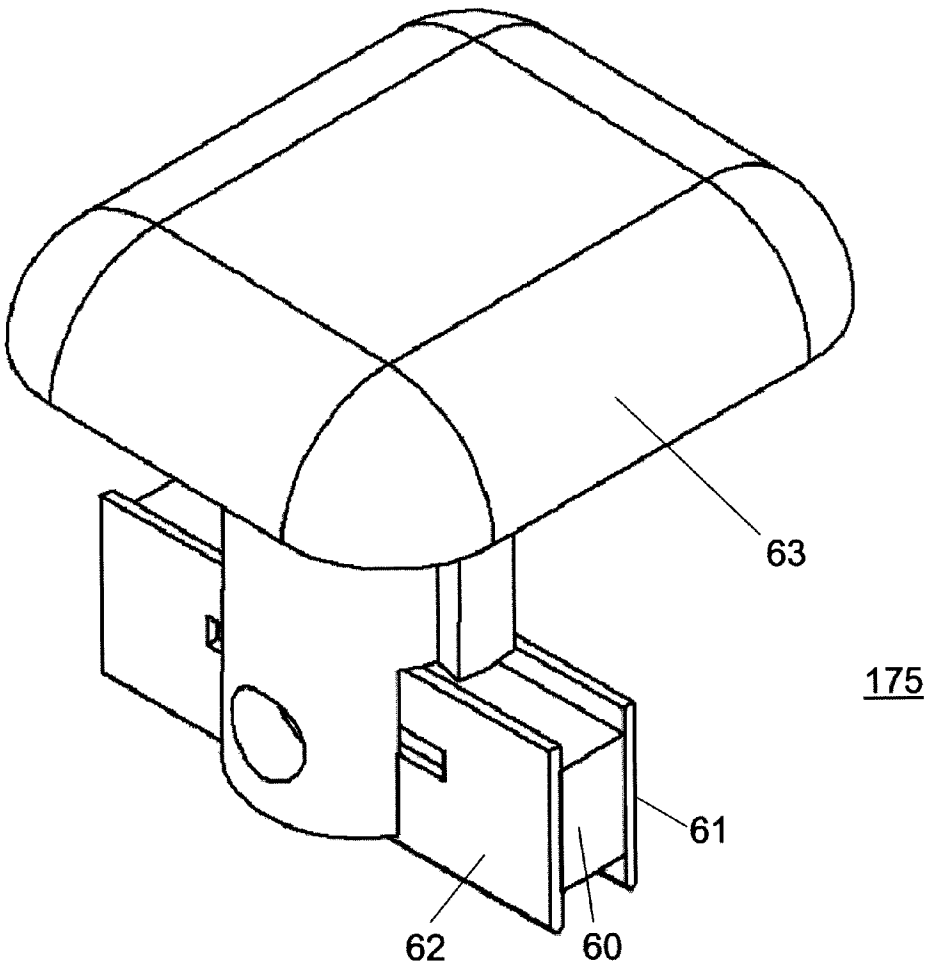
FIG. 10 is an isometric view of one embodiment of a combined tape cutting and scoring assembly for a portable electromechanical Braille label maker.
Figure 11A:
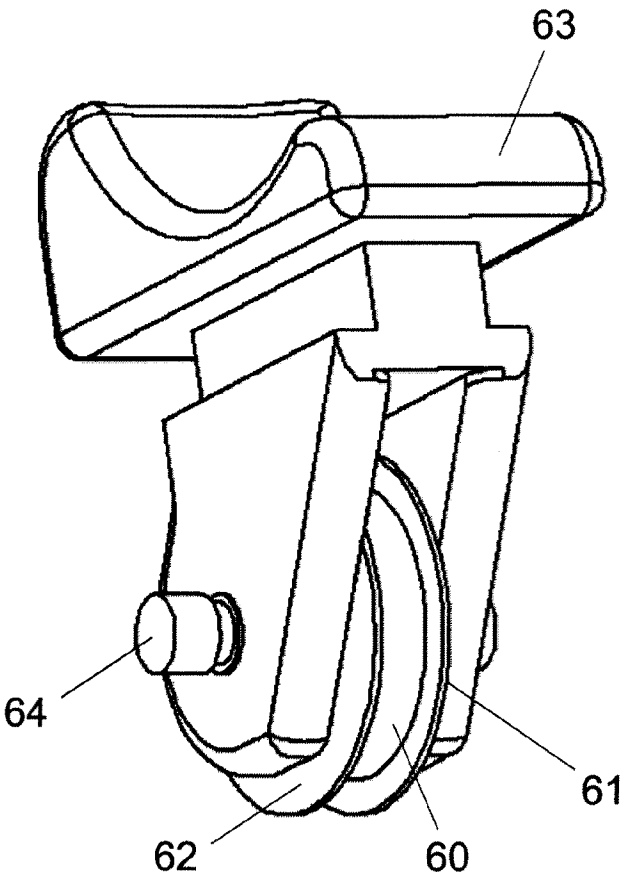
FIG. 11A is an isometric view of another embodiment of a combined tape cutting and scoring assembly for a portable electromechanical Braille label maker.

FIGS. 10 and 11A illustrate embodiments of a combined tape cutting and scoring assembly 175 for use in a portable electromechanical Braille label maker 100. As shown in FIGS. 10 and 11A, the illustrated embodiments include a cutting blade 61 and a scoring blade 62. The cutting blade 61 is configured to cut the tape 50 completely when the blade driver mechanism 63 is actuated. The scoring blade 62 is configured to score the tape 50 when the blade driver mechanism 63 is actuated, so that the release liner 52 may be easily removed. The cutting blade 61 may be rigidly coupled to a blade driver mechanism 63. The scoring blade 62 may be compliantly coupled to the cutting blade 61 via a bridge 60. The bridge 60 may be any compliant material, such as, for example, rubber or plastic. Alternatively, the bridge 60 may be any structure that can be used to join the scoring blade 62 to the cutting blade 61 in a compliant manner. For example, the bridge 60 may be a spring. The bridge 60 not only compliantly joins cutting blade 61 and scoring blade 62, but also offsets the scoring blade 62 from the cutting blade 61.

Figure 12A:
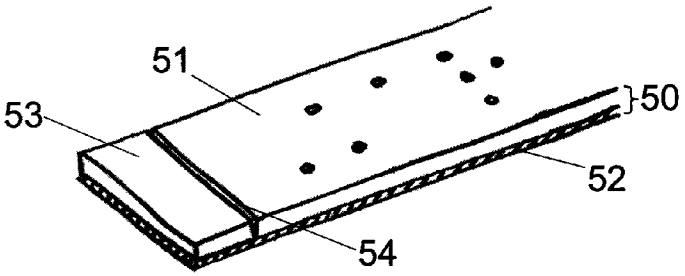
FIG. 12A shows an embodiment of a cut and scored labeling tape.
Figure 12B:
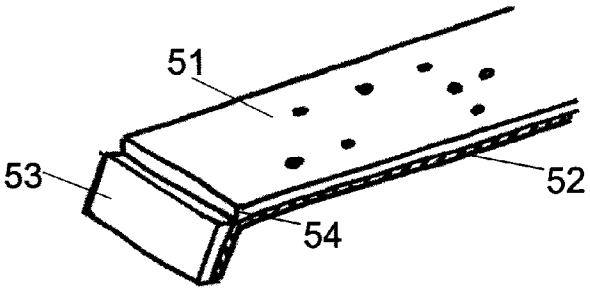
FIG. 12B is a plan view of an embodiment of a cut and scored labeling tape after the score has been used to snap the tape in half.
Figure 12C:
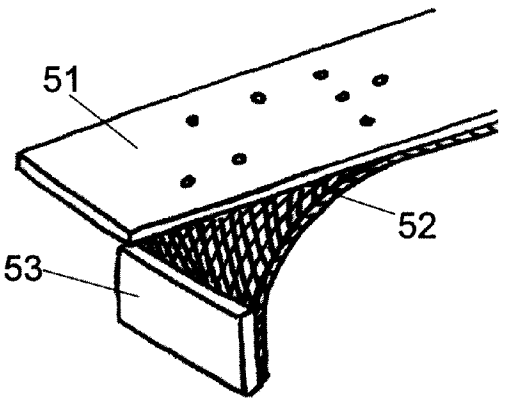
FIG. 12C is a plan view of an embodiment of a cut and scored labeling tape with the adhesive backing partially removed from the main label.

As illustrated in FIGS. 10 and 11A, the blade driver mechanism 63 may be embodied as a button or handhold that a user presses in order to cut and score the tape 50. Alternatively, the blade driver mechanism 63 may be coupled to an actuator (not shown) that is controlled by the controller 132 when the user indicates through the user interface 120 that the tape 50 is to be cut. When the blade driver mechanism 63 is activated (for example, by a user pressing on the blade driver mechanism 63 illustrated in FIGS. 10 and 11A), the cutting blade 61 pierces all the way through the tape 50, including through the adhesive backing 52. The scoring blade 62, however, is sized and configured so it only scores or partially cuts through the tape 50, leaving the tape backing 52 intact. As illustrated in FIGS. 12A-12C, this creates a small tab 53 that a user may hold to peel back the adhesive backing. The bridge 60, therefore, may be designed with a compliant material or compliant mechanism that is stiff enough to force the scoring blade 62 through at least part of the tape 50, but compliant enough so that the scoring blade 62 does not completely cut through the tape 50. Persons of skill in the art will be able to determine an appropriate compliant material or compliant mechanism and size the scoring blade 62 to accomplish this scoring task.

As shown in the embodiment illustrated in FIG. 10, the cutting blade 61 and scoring blade 62 may be straight blades. In this embodiment, the user presses down on the blade driver mechanism 63, which is a button, to press the cutting blade 61 and scoring blade 62 against the labeling tape 50. As illustrated in FIGS. 3 and 4, a cutting board 10 may be provided for the cutting blade 61 to press against. As shown in FIGS. 3 and 4, the cutting mechanism and board 10 may be provided close to the embossing area 3 so that the labeling tape 50 may be cut close to the end of the last Braille character.

The cutting blade 61 and scoring blade 62 may be of any suitable shape. For example, as shown in the embodiment illustrated in FIG. 11A, cutting blade 61 and scoring blade 62 may be round blades that are rolled across the tape 50 so that the round cutting edges cut through the tape 50. In this embodiment, the scoring blade 62 may be compliantly attached to the cutting blade 61 in any suitable manner, such as with the use of a compliant material 60 or mechanism. The central shaft 64 may be a smaller diameter or the scoring blade 62 and bridge may have a center larger than the diameter of the central shaft 64 in order to provide the needed compliance. Also, as illustrated in FIG. 11A, the blade driver mechanism 63 may be shaped to lead the user to roll the blades 61, 62 in a certain direction to cut the tape 50.

Figure 11C:
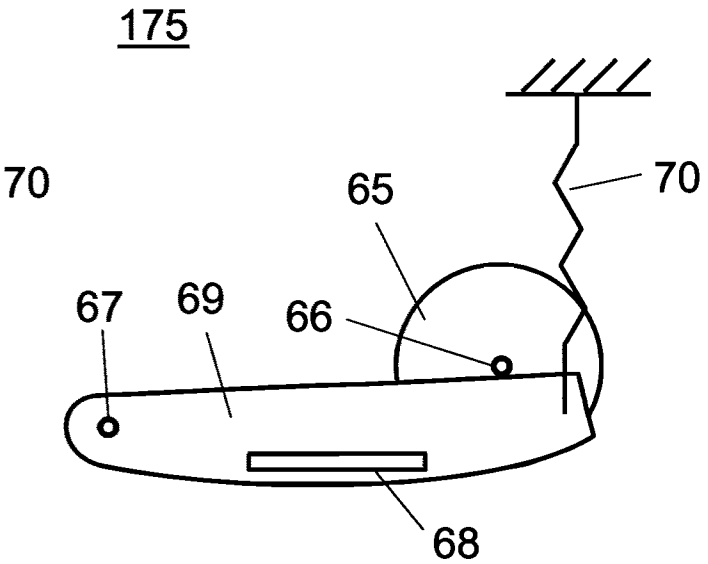
FIGS. 11B and 11C are schematic side views of another embodiment of a combined tape cutting and scoring assembly for a portable electromechanical Braille label maker.
Figure 11B:
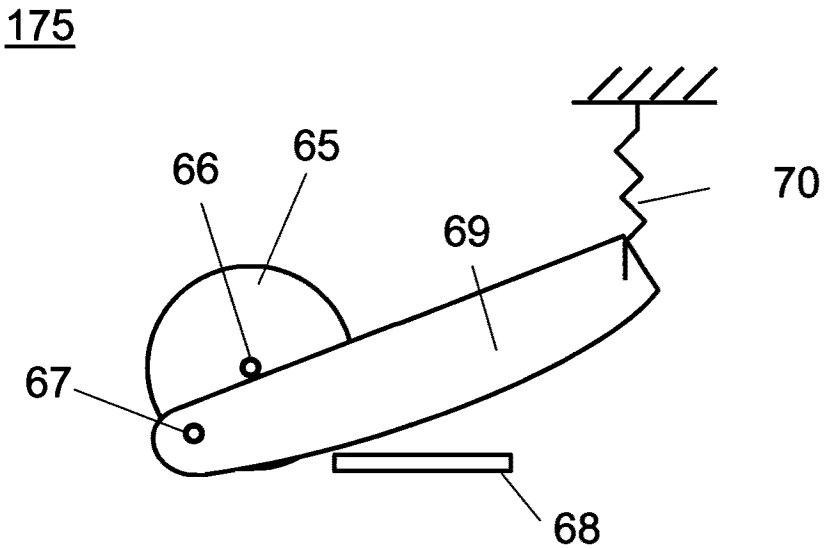

Cutting the tape may also be accomplished by a hinged blade 69 and scoring the tape may be accomplished by a rolling blade 65 mounted with some compliance, as illustrated in FIG. 11B and FIG. 11C. In this embodiment, the hinged blade 69 is positioned at an inclined angle with respect to the tape 68, held away from the tape 68 by a spring 70 as shown in FIG. 11B. When the rolling blade 65 is slid across the tape 68 away from the pivot point 67 of the hinged blade 69, the rolling blade axle 66 depresses the hinged blade 69 to decrease the angle between the hinged blade and the tape, thereby slicing the tape 68, as shown in FIG. 11C. During this motion, the rolling blade 65 scores the tape 68 but does not cut it completely. When the rolling blade 65 is slid back towards the pivot point 67 of the hinged blade, the spring 70 attached to the hinged blade 69 raises the hinged blade 69. Using this mechanism, the user may both cut and score the labeling tape with a sliding motion similar to that used for the embodiment illustrated in FIG. 11A.

FIGS. 12A-12C illustrate how to easily use the cut and scored labeling tape 50. FIG. 12A shows the cut and scored labeling tape 50 with an adhesive backing 52. The notch 54 created by the scoring blade 62 creates a small tab 53 separate from the main label 51. As shown in FIG. 12B, the small tab 53 should be bent backwards to fully snap and separate the main label 51 from the small tab 53 at the notch 54. The adhesive backing 52, however, remains intact. As shown in FIG. 12C, the small tab 53 can then be used to pull the adhesive backing 52 off of the main label 51. Although FIGS. 12A-12C illustrate the labeling tape 50 being scored on the face of the label, the combined tape cutting and scoring assembly 175 could also be used to score the back of the label.

The portable Braille label maker is an electromechanical device that may be powered using any suitable power source, including, but not limited to, batteries, an AC or DC power source, and/or solar panels.

Although the assemblies and mechanisms have been described above in the context of a Braille label maker, the embossing mechanism may be used for any application that requires the embossing of dots.

The "dots" may be of any size or shape, including, but not limited to, round dots, oval dots, and regular or irregular polygons. The "dots" may further be either solid or hollow. For example, a star-shaped dot could either emboss a solid star, or just the outline of the star. Persons of skill in the art would know how to modify the second end of the embossing pin and the stamp plate 8 in order to emboss different kinds of "dots."

The tape advance mechanism 150 may be used in any device that needs to advance tape.

The combined tape cutting and scoring assembly 175 may be used in any device to cut and score tape.

Any reference to claim elements in the singular, for example, using the articles "a," "an" or "the" is not to be construed as limiting the element to the singular.

The preceding description of the disclosed embodiments is provided to enable any person skilled in the art to make or use the present invention. Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit and scope of the invention.

What is claimed is:

1. An apparatus for embossing a pattern of dots on a tape, comprising:

an embossing assembly configured to emboss the pattern of dots, the embossing assembly comprising:

a die assembly;

three actuators;

three shafts each coupled to one of the three actuators, each shaft including two cams;

six embossing pins, wherein the six embossing pins are configured in the embossing assembly such that each embossing pin is positioned so as to be driven by one cam of one shaft into the die assembly and the six embossing pins are arranged in a two-by-three matrix of three rows of two embossing pins each; and a controller coupled to the three actuators and configured to control the embossing assembly in response to user inputs, wherein the three shafts and each of the cams on each shaft are oriented within the embossing assembly and configured such that the two cams on each shaft actuate the two embossing pins in a single row, and wherein the controller is configured to control each of the three actuators to independently (i) rotate its coupled shaft through a predetermined angle in a first direction to cause a first of two cams on the shaft to drive a first embossing pin in a row into the die assembly to form a first dot in the row, (ii) rotate its coupled shaft through the predetermined angle in a second rotational direction opposite the first rotation direction to cause a second of two cams on the shaft to drive a second embossing pin in the row into the die assembly to form a second dot in the row, and (iii) rotate its coupled shaft through the predetermined angle in the first direction and then through the predetermined angle in the second direction while the tape remains in the same tape position to form both dots in the row.

2. The apparatus of claim 1, further comprising a tape advance assembly coupled to the controller, the tape advance assembly comprising:

a housing including a tape slot and a friction wheel; and a cover including an idler wheel positioned so that the idler wheel engages the friction wheel to hold a piece of labeling tape against the friction wheel when the cover is closed on the housing.

3. The apparatus of claim 2, further comprising a drive mechanism mechanically coupled to the friction wheel and electrically coupled to the controller, wherein the controller is further configured to cause the drive mechanism to rotate the friction wheel in response to a user input to advance the tape after controlling the three actuators to form a pattern of dots.

4. The apparatus of claim 2, further comprising a drive mechanism that is one of a stepper motor or a servo.

5. The apparatus of claim 1, further comprising a combined tape cutting and scoring assembly comprising: a cutting blade; a scoring blade; and a compliant connection mechanism coupling the scoring blade to the cutting blade.

* * * * *